US006880314B2

(12) United States Patent
Haasl

(10) Patent No.: US 6,880,314 B2
(45) Date of Patent: Apr. 19, 2005

(54) BANDING SYSTEM INCLUDING AN INTERNAL BACKING MEMBER FOR WRAPPING AN ELONGATED ARTICLE SUCH AS A STACK OF INTERFOLDED PAPER TOWELS

(75) Inventor: Andrew L. Haasl, Green Bay, WI (US)

(73) Assignee: FPNA Acquisition Corporation, Green Bay, WI (US)

( * ) Notice: Subject to any disclaimer, the term of this patent is extended or adjusted under 35 U.S.C. 154(b) by 0 days.

(21) Appl. No.: 10/627,477

(22) Filed: Jul. 25, 2003

(65) Prior Publication Data

US 2004/0068966 A1 Apr. 15, 2004

Related U.S. Application Data

(63) Continuation of application No. 10/206,506, filed on Jul. 26, 2002.

(51) Int. Cl.[7] ..... B65B 9/02; B65B 9/06

(52) U.S. Cl. ..... 53/450; 53/375.8; 53/376.2; 53/550; 53/553

(58) Field of Search ..... 53/520, 528, 530, 53/463, 375.8, 376.2, 450

(56) References Cited

U.S. PATENT DOCUMENTS

| | | | |
|---|---|---|---|
| 2,636,654 | A | 4/1953 | Sykes |
| 2,721,017 | A | 10/1955 | Hiscock |
| 2,737,002 | A | 3/1956 | Demler |
| 3,006,119 | A | 10/1961 | Fingerhut |
| 3,057,125 | A | 10/1962 | Jensen et al. |
| 3,063,215 | A | 11/1962 | Parks |
| 3,069,826 | A | 12/1962 | Littlefield et al. |
| 3,099,118 | A | 7/1963 | Stelling, Jr. |
| 3,166,462 | A | 1/1965 | Schoder |
| 3,238,697 | A | 3/1966 | Zucker |

(Continued)

*Primary Examiner*—Scott A. Smith
*Assistant Examiner*—Gloria R. Weeks
(74) *Attorney, Agent, or Firm*—Boyle, Fredrickson, Newholm, Stein & Gratz, S.C.

(57) ABSTRACT

A wrapping apparatus for wrapping a continuous elongated article, such as a continuous stack of interfolded paper towels, includes a web supply section that supplies a pair of continuous webs of wrapping material, and a wrapping section for applying the continuous pair of webs about the article. The web supply section includes a pair of web supply stations for each web of wrapping material, and a source of wrapping material, such as a supply roll, is located at each web supply station. The web supply section includes a splicing mechanism for each pair of web supply stations, for splicing together the trailing end of a web from an exhausted supply roll of wrapping material with the leading end of a web from a fresh supply roll of wrapping material, to provide a continuous web of wrapping material to the wrapping section. The web supply section includes a festoon-type web storage mechanism in which the web downstream of the splicing mechanism is trained about a series of rollers in a serpentine path. The rollers are movable toward and away from each other, e.g. by mounting one set of rollers to a movable frame, to enable the web to be continuously supplied to the wrapping section during the splicing operation, which maintains the web ends stationary during splicing. The webs of wrapping material are applied to the elongated article such that side areas of the webs overlap each other, and adhesive such as hot glue is applied between the overlapping areas of the webs. A pressure application assembly applies pressure to the overlapping areas of the webs to even out the adhesive, and the wrapped elongated article is discharged from the wrapping section through a discharge passage which includes a cooling assembly for extracting heat from the seal between the overlapping webs. The wrapped elongated article is then discharged from the wrapping section for subsequent processing.

13 Claims, 12 Drawing Sheets

U.S. PATENT DOCUMENTS

| | | | | | |
|---|---|---|---|---|---|
| 3,327,452 | A | | 6/1967 | Cranston, Jr. et al. | |
| 3,343,334 | A | | 9/1967 | Bode et al. | |
| 3,417,544 | A | | 12/1968 | Grevich | |
| 3,445,983 | A | | 5/1969 | Stevens | |
| 3,507,091 | A | | 4/1970 | Mizelle et al. | |
| 3,545,166 | A | | 12/1970 | Johnson et al. | |
| 3,604,182 | A | | 9/1971 | Jepsen | |
| 3,643,399 | A | | 2/1972 | Bertoglio | |
| 3,701,232 | A | | 10/1972 | Parker | |
| 3,729,886 | A | | 5/1973 | Lucas et al. | |
| 3,731,452 | A | | 5/1973 | Rias | |
| 3,775,930 | A | | 12/1973 | Mercer et al. | |
| 3,837,138 | A | | 9/1974 | Terry | |
| 3,848,398 | A | | 11/1974 | Suhr | |
| 3,928,941 | A | | 12/1975 | Singer | |
| 3,952,479 | A | | 4/1976 | Achelpohl | |
| 3,975,888 | A | | 8/1976 | Jones | |
| 4,047,362 | A | | 9/1977 | Lister et al. | |
| 4,242,854 | A | | 1/1981 | Nissen | |
| 4,328,655 | A | | 5/1982 | Spencer et al. | |
| 4,592,193 | A | | 6/1986 | Gustavsson | |
| 4,626,236 | A | | 12/1986 | Maurer | |
| 4,679,379 | A | * | 7/1987 | Cassoli | 53/438 |
| 4,748,799 | A | | 6/1988 | Truc et al. | |
| 4,800,705 | A | | 1/1989 | Bodolay | |
| 4,854,108 | A | * | 8/1989 | Cassoli | 53/209 |
| 4,858,416 | A | | 8/1989 | Monaghan | |
| 4,875,328 | A | | 10/1989 | Meyer | |
| 4,909,388 | A | | 3/1990 | Watanabe | |
| 5,002,235 | A | | 3/1991 | Greer et al. | |
| 5,195,300 | A | | 3/1993 | Kovacs et al. | |
| 5,331,788 | A | * | 7/1994 | Cinotti | 53/228 |
| 5,367,858 | A | | 11/1994 | Haasl | |
| 5,428,937 | A | | 7/1995 | Misik | |
| 5,884,458 | A | | 3/1999 | Alvarez | |
| 5,979,145 | A | | 11/1999 | Louis et al. | |
| 6,122,894 | A | | 9/2000 | Romagnoli | |
| 6,195,966 | B1 | | 3/2001 | Shomron et al. | |
| 6,256,969 | B1 | | 7/2001 | Fragstein | |
| 6,526,729 | B1 | * | 3/2003 | Herava | 53/465 |
| 2002/0073649 | A1 | * | 6/2002 | Gamberini | 53/228 |

* cited by examiner

BANDING SYSTEM INCLUDING AN INTERNAL BACKING MEMBER FOR WRAPPING AN ELONGATED ARTICLE SUCH AS A STACK OF INTERFOLDED PAPER TOWELS

CROSS-REFERENCE TO RELATED APPLICATION

This application is a continuation of application Ser. No. 10/206,506 filed Jul. 26, 2002.

BACKGROUND AND SUMMARY OF THE INVENTION

This invention relates to a system for applying a sleeve-type wrapper to an elongated article such as a compressible elongated stack or log of interfolded paper towels or the like.

Articles such as paper towels are typically packaged by compressing a stack of articles and applying a pair of webs about the compressed stack. The webs are applied such that end portions of the webs overlap each other, and an adhesive is placed between the overlapping portions of the webs. The webs are thus secured together about the stack, to form a band or wrapper that maintains the stack in compression during shipment and storage.

Different types of wrapping or banding systems have been developed for wrapping a compressed stack of articles such as paper towels. In one such system, a stack of interfolded paper towels is first cut to length, and is advanced by a pair of convergent belts which apply compression to the stack. Top and bottom sheets of wrapping material are applied about the compressed stack, such that the side edges of the sheets overlap each other, and the overlapping side edges are secured together by an adhesive so as to form individually wrapped packages. In another system, the individual sheets of wrapping material are replaced with upper and lower rolled webs of wrapping material, which are applied to an elongated log or stack of interfolded paper towels. The stack is simultaneously advanced and compressed, and the upper and lower webs are unwound from the supply rolls of web material and applied to the compressed stack such that the side edges of the upper and lower webs of wrapping material overlap each other. Adhesive is applied between the overlapping side edges of the webs, which are pressed together as the stack is advanced through a discharge section of the apparatus, which allows the adhesive to set. The webs are severed in a location corresponding to the end of the stack or log, such that the upper and lower webs are applied to the full length of the log. The wrapped log is then supplied to a cutting mechanism such as a log saw, where the log is cut into lengths according to customer specifications in preparation for packaging and shipment. This type of system is advantageous in that a relatively long stack or log can be wrapped in a single wrapping operation, and subsequently cut into individual packages of any desired length.

Advances in interfolding technology have enabled production of a substantially continuous stack or log of articles such as interfolded paper towels. However, drawbacks are associated with utilization of packaging or banding systems as described above in connection with a continuously produced log of paper towels. In order to adapt the prior art wrapping system, the continuous log must be cut to length to form individual stacks which are then wrapped or banded. This detracts from the overall goal of a continuous production facility by adding the step of cutting the continuously produced log prior to wrapping. While other types of prior art wrapping systems provide the ability to wrap a relatively long article by supplying the wrapping material from rolls, the maximum length of the log that can be wrapped is dictated by the length of the web of wrapping material wound onto the supply roll.

It is an object of the present invention to provide a system for applying a sleeve-type package or wrapper to an elongated article, which is capable of providing continuous operation so as to enable packaging of a continuous article, such as an elongated continuous stack or log of interfolded paper towels. Another object of the invention is to provide such a system in which the webs of wrapping material are applied in a manner similar to that of the prior art, to produce packages, such as wrapped paper towels, that have essentially the same construction as in the prior art. Another object of the invention is to provide such a system which has the capability to continuously wrap an elongated article and which requires minimal manpower to maintain the supply of wrapping material. Yet another object of the invention is to provide such a system which utilizes existing technological concepts in advancement of the elongated article, such as the continuous stack or log of interfolded paper towels, and incorporates a feature for continuously supplying wrap material.

In accordance with the present invention, a system for wrapping an elongated article, such as a continuous stack or log of interfolded paper towels, includes an advancing mechanism engaged with the elongated article, which is operable to advance the elongated article in a direction along a longitudinal axis defined by the elongated article. The system further includes a first web supply arrangement for continuously supplying a first web of wrapping material, and a second web supply arrangement for continuously supplying a second web of wrapping material. The system further includes a web application arrangement for applying the first and second webs of wrapping material to the elongated article as the elongated article is advanced by the advancing mechanism. The web application arrangement is operable to apply the first and second webs such that adjacent end areas of the first and second webs overlap each other. The system further includes a bonding arrangement for bonding the overlapping end areas of the first and second webs together so as to secure the first and second webs about the elongated article.

The first and second web supply arrangements each include a pair of web supply stations, each of which is adapted to supply a web of wrapping material from a source such as a supply roll. Each of the first and second web supply arrangements further includes a splicing mechanism, which is operable to splice together the trailing end of a web of wrapping material from one of the sources with the leading end of the web of wrapping material from the other of the sources, to provide a continuous supply of the web of wrapping material to the web application arrangement. The trailing and leading ends of the respective webs of wrapping material are temporarily maintained stationary while the splicing mechanism splices the web ends together. Each web supply arrangement further includes a take-up or traveling web storage arrangement downstream of the splicing mechanism and upstream of the web application arrangement. In this manner, the web of wrapping material is continuously supplied to the web application arrangement from the take-up or storage arrangement while the ends of the respective webs are maintained stationary for splicing together. In one form, the take-up or storage arrangement is in the form of a festoon-type mechanism consisting of a series of stationary rollers and a series of movable rollers which are movable toward and away from the stationary rollers, and the web of wrapping material is trained about both the stationary and movable rollers. While the web ends are maintained stationary for splicing, the web of wrapping material continues to be advanced downstream of the splicing arrangement, and the movable rollers of the festoon-type mechanism are moved toward the stationary rollers to enable a continuous supply of the web of wrapping material to the web application arrangement during the splicing operation. Subsequently, the spliced web is allowed to be advanced, to enable the movable rollers to again be moved away from the stationary rollers so as to restore the length of the web that travels through the festoon-type mechanism to any amount sufficient to accommodate a subsequent splicing operation. In one embodiment, the movable rollers are carried by a movable arm, which provides the storage capacity for the web of wrapping material so as to enable the web of wrapping material to continuously be supplied to the web application arrangement while the web ends are maintained stationary during the splicing operation.

The advancing mechanism is operable to advance the elongated article in a first direction along the longitudinal axis define by the elongated article. The first and second web supply arrangements are oriented so as to supply the first and second webs of wrapping material in a second direction transverse to the first direction, such that the web supply arrangements do not interfere with the elongated article as it is supplied to the advancing mechanism. Each of the first and second webs of wrapping material is engaged with a diverter located between the respective web supply arrangement and the web application arrangement, to change the direction of movement of the web from the second direction to the first direction prior to supply of the web to the web application arrangement.

Each web supply station is configured to supply a web of wrapping material from a source, such as a supply roll of wrapping material which is rotatably supported at the web supply station, e.g. by engagement with a spindle or the like. An unwind mechanism is provided at each web supply station for imparting rotation to the web supply roll. In one embodiment, the unwind mechanism is a pivoting belt-type arrangement that engages the outer surface of the roll to assist in rotating the roll about the spindle. Each web supply station further includes a hoist for use in lifting the supply roll and engaging the supply roll with the spindle.

The invention contemplates an apparatus for wrapping an elongated article such as a continuous stack or log of interfolded paper towels, as well as a method of wrapping an elongated article, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
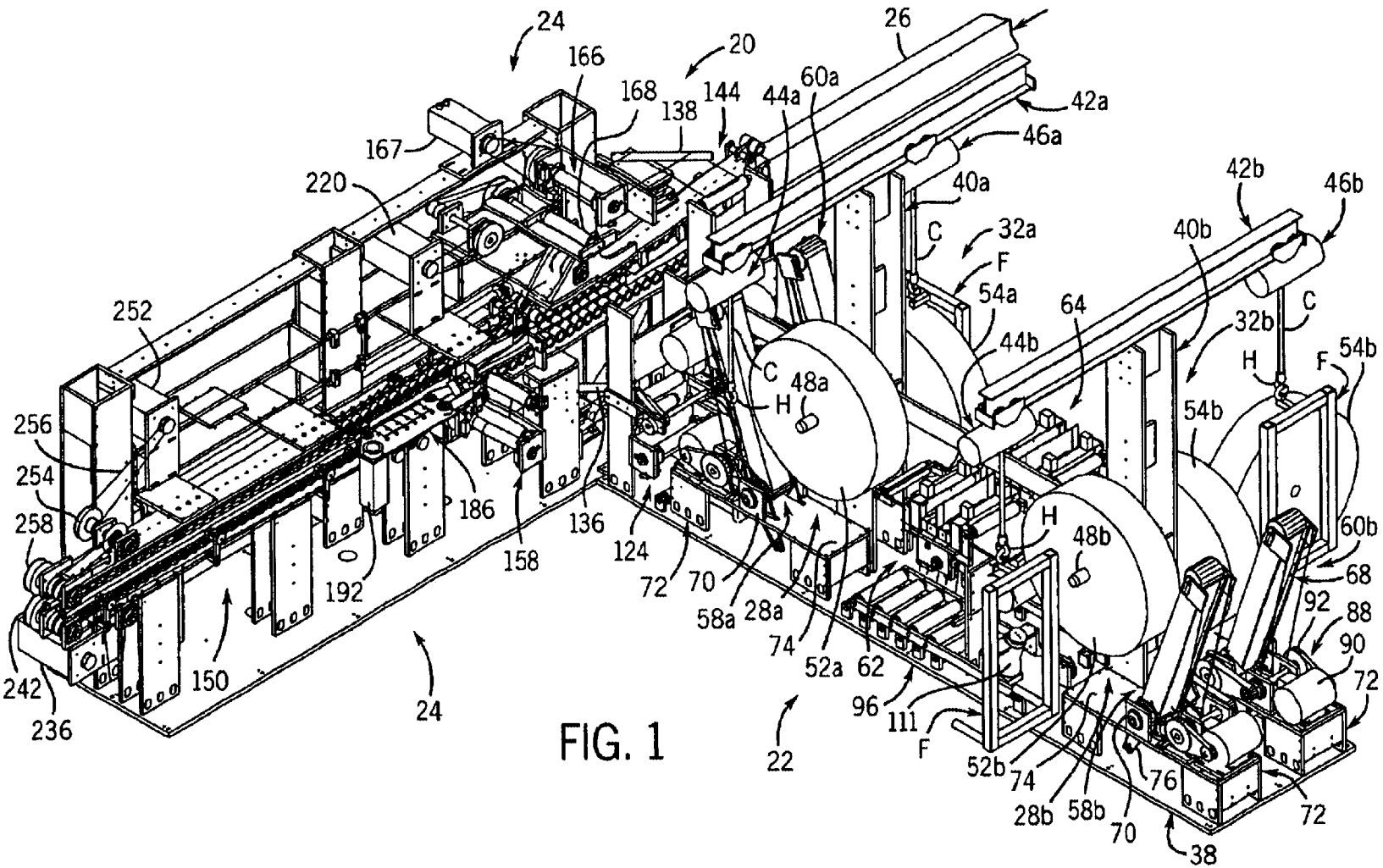
FIG. 1 is an isometric view of a system for continuously wrapping an elongated article such as a continuous stack or log of interfolded paper towels, in accordance with the present invention.

FIG. 1 illustrates a sleeve-type wrapping or packaging system 20 in accordance with the present invention. Generally, wrapping system 20 includes a web supply section 22 and a wrapping section 24. Wrapping system 20 is adapted to apply a wrapper formed of a pair of webs about an elongated article, shown at 26, which representatively may be a continuous stack or log of interfolded paper towels, or any other type of elongated article adapted to be wrapped or encased in a sleeve-type wrapper. In an embodiment in which elongated article 26 is a continuous stack or log of interfolded paper towels, the interfolded towels are formed from a large number of continuously supplied paper towel webs which are subjected to an interfolding operation and formed into the continuous stack or log, represented as elongated article 26. Wrapping system 20 functions to receive elongated article 26 and to subject elongated article 26 to compression, and to thereafter wrap a pair of webs about the compressed elongated article 26 and bond or seal the webs together, to produce a compressed and wrapped elongated article 26 that can be supplied to a saw or the like which severs the wrapped article 26 into individual sections for shipment. Hereafter, elongated article 26 will be referred to as a stack or log of interfolded paper towels, although it is understood that wrapping system 20 of the present invention may be utilized to wrap any other type of elongated article.

Wrapping system 20 functions to apply a pair of webs of wrapping material about elongated article 26 as elongated article 26 is advanced through wrapping section 24. The pair of webs are supplied to wrapping section 24 from web supply section 22.

Figure 2A:
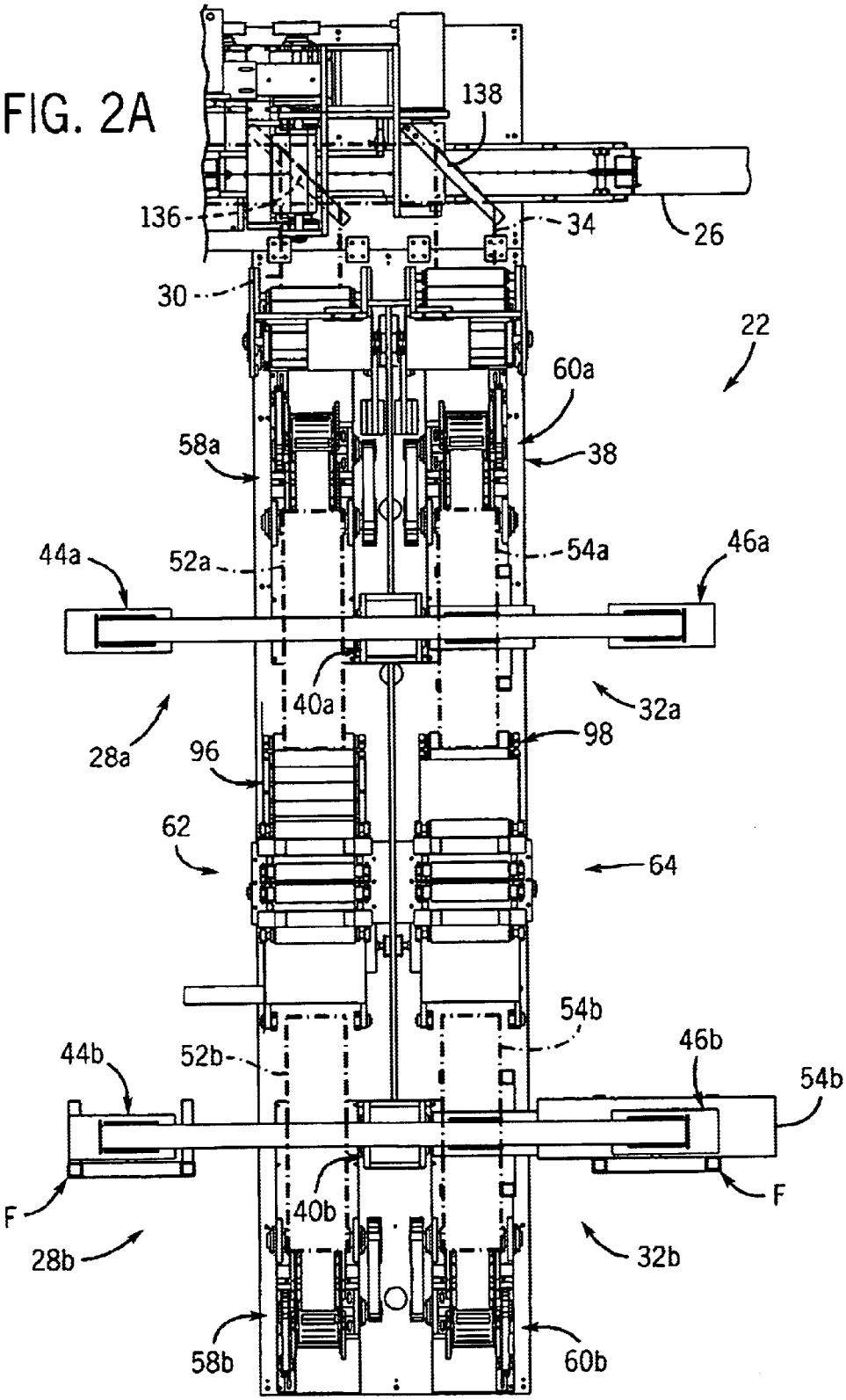
FIG. 2A is a top plan view of a portion of the wrapping system of FIG. 1, showing the web supply arrangements for continuously supplying first and second webs of wrapping material.

As shown in FIGS. 1 and 2A, web supply section 22 includes a pair of web supply stations shown generally at 28*a,* 28*b* for supplying a first web of wrapping material, shown at 30, to wrapping section 24, and a second pair of web supply stations 32*a,* 32*b* for supplying a second web of wrapping material, shown at 34, to wrapping section 24.

Web supply section 22 includes a base plate 38 on which the components of web supply section 22 are supported. Base plate 38 is adapted to rest on a floor or other supporting surface forming a part of the production facility within which wrapping system 20 is located, although it is understood that any other satisfactory type of support arrangement may be employed. A pair of support columns 40*a,* 40*b* are mounted at their lower ends to base plate 38, and extend vertically upwardly therefrom. A transverse beam 42*a* is mounted to the upper end of support column 40*a,* and a transverse beam 42*b* is mounted to the upper end of support column 40*b.* A wheeled hoist 44*a* is movably engaged with beam 42*a* at first web supply station 28*a,* and a wheeled hoist 44*b* is movably engaged with beam 42*b* at first web supply station 28*b.* Similarly, a wheeled hoist 46*a* is engaged with beam 42*a* at second web supply station 32*a,* and a wheeled hoist 46*b* is movably engaged with beam 42*b* at second web supply station 32*b.*

Figure 3:
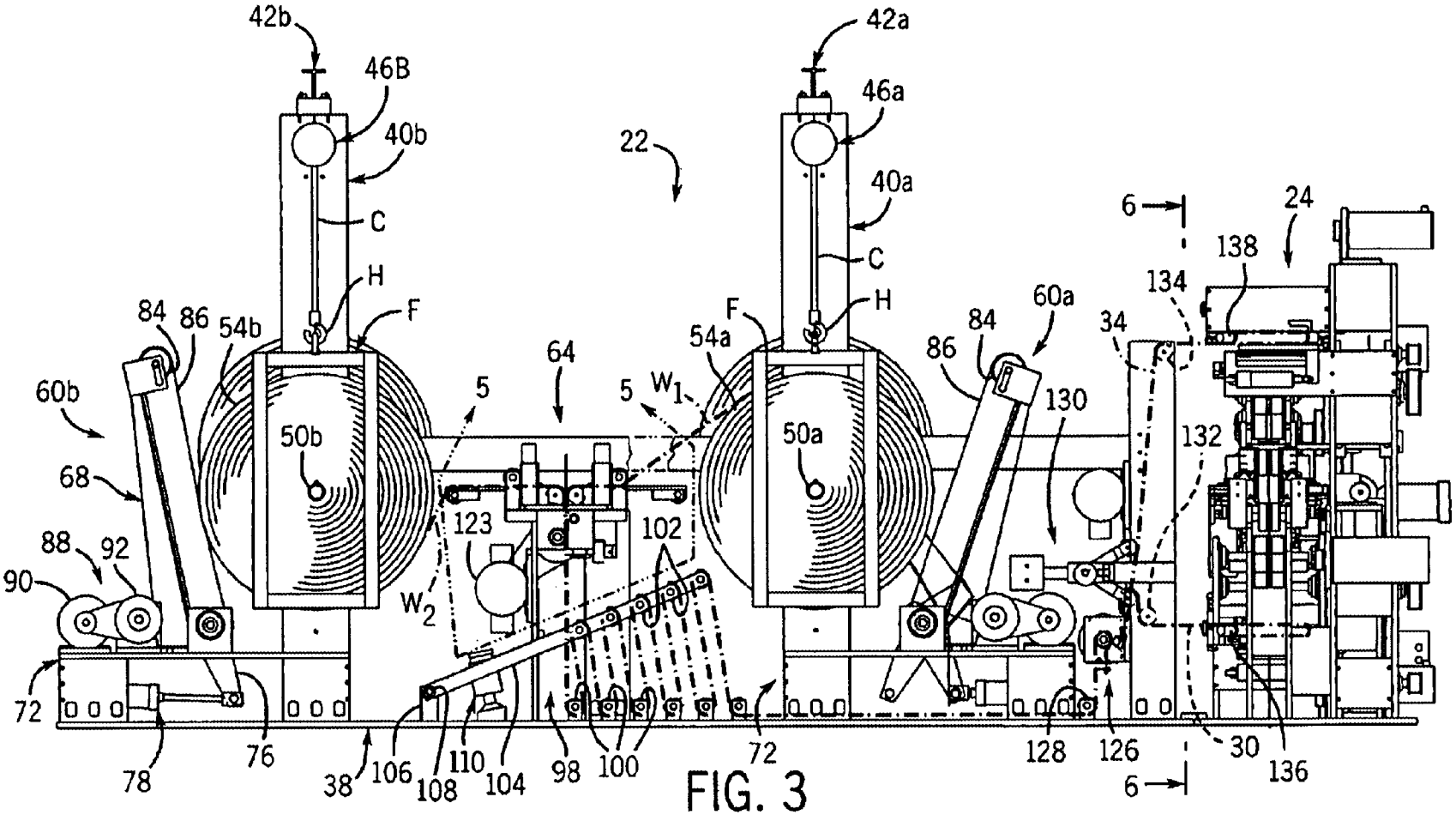
FIG. 3 is an elevation view of the wrapping system of FIG. 1, primarily showing one of the web supply arrangements shown in plan in FIG. 2A.
Figure 4:
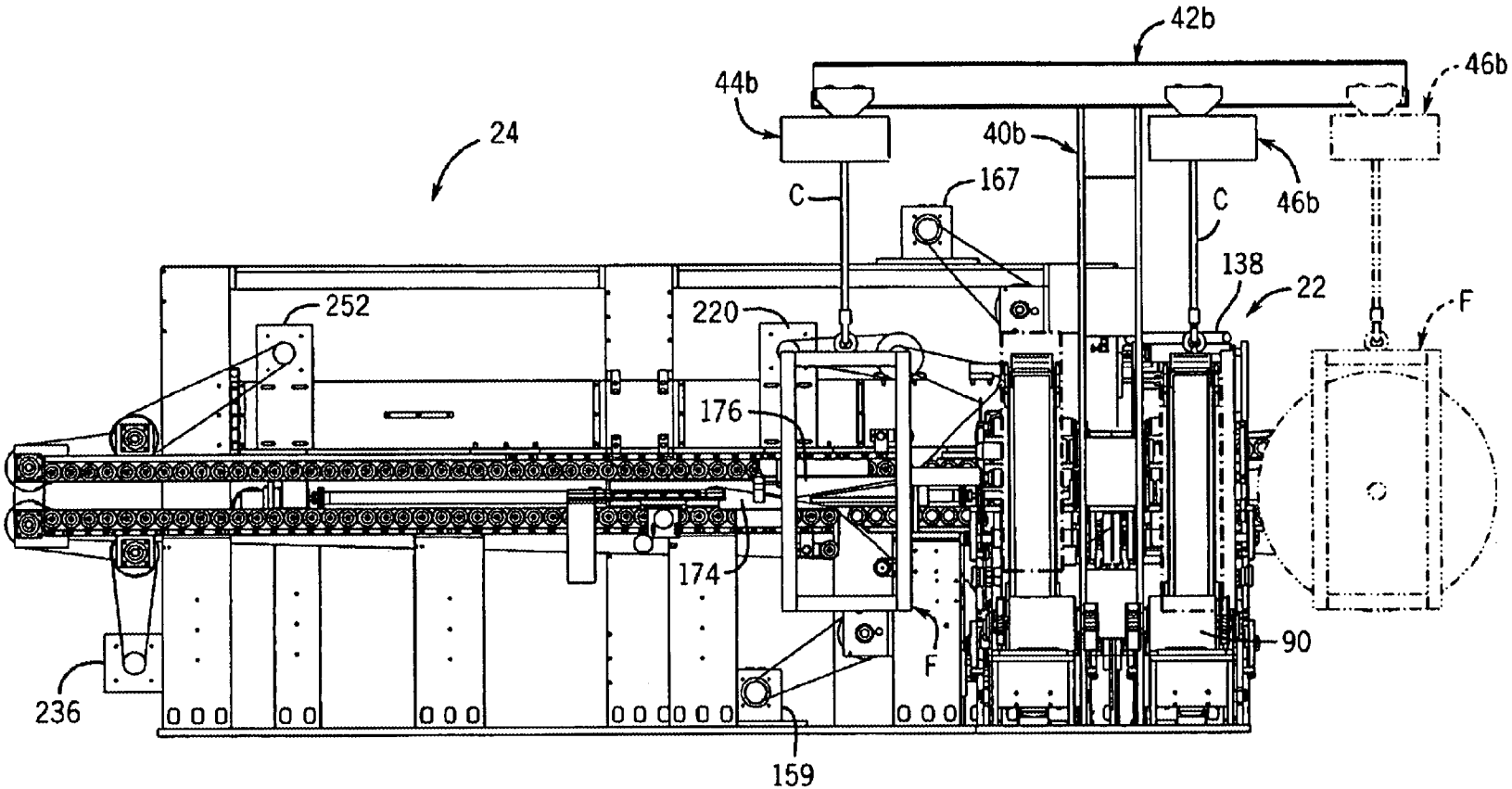
FIG. 4 is another elevation view of the wrapping system of FIG. 1, primarily showing the article advancement and web application features shown in plan in FIG. 2B.

A spindle 48*a* is mounted to and extends outwardly from engaged with support column 40*a* at web supply station 28*a,* and a spindle 48*b* is mounted to and extends outwardly from support column 40*b* at web supply station 28*b.* Similarly, as shown in FIG. 3, a spindle 50*a* is mounted to and extends outwardly from support column 40*a* at web supply station 32*a,* and a spindle 50*b* is mounted to and extends outwardly from support column 40*b* at web supply station 32*b.*

A first roll 52*a* of web-type wrapping material, such as a kraft paper material, is rotatably supported on spindle 48*a* at web supply station 28*a,* and a second roll of web-type wrapping material is rotatably supported on spindle 48*b* at web supply station 28*b.* Similarly, a first roll of web-type wrapping material 56*a* is rotatably supported on spindle 50*a* at web supply station 32*a,* and a second roll of web-type wrapping material 54*b* is rotatably supported on spindle 50*b* at web supply station 32*b.* Rolls 52*a,* 52*b* are alternately or sequentially unwound so as to continuously supply first web 30 to wrapping section 24. Similarly, rolls 54*a,* 54*b* are alternately or sequentially unwound so as to continuously supply second web 34 to wrapping section 24. In a manner to be explained, the trailing end of one of rolls 52*a,* 52*b* is spliced to the leading end of the other of rolls 52*a*, 52*b* to continuously supply first web 30. Similarly, the trailing end of one of rolls 54*a,* 54*b* is spliced to the leading end of the other of rolls 54*a,* 54*b,* to continuously supply second web 34.

Hoists 44*a,* 44*b* are employed to lift rolls 52*a,* 52*b,* respectively. Hoists 44*a,* 44*b* travel on beams 42*a,* 42*b,* respectively, so as to enable rolls 52*a,* 52*b* to be mounted to spindles 48*a,* 48*b,* respectively. Similarly, hoists 46*a,* 46*b* are utilized to lift rolls 54*a,* 54*b,* respectively. Hoists 46*a,* 46*b* travel on respective beams 42*a,* 42*b* to enable rolls 54*a,* 54*b* to be mounted to spindles 50*a,* 50*b,* respectively. Each hoist includes a lifting cable C having a hook H at its lower end, which is adapted to engage a transport frame F configured to support one of the rolls during transport. Using the transport frame F, each roll is secured to the hoist hook H so as to enable the roll to be lifted by the hoist, and the hoist is then moved on the respective beam so as to engage the roll with its respective spindle. The frame 56 is then disengaged from the roll, and is employed to transport another roll for replacing the prior roll when it is exhausted.

Each web supply station includes an unwind mechanism for imparting rotation to its associated roll to rotate the roll about its respective spindle. Web supply station 28*a* includes a web unwind mechanism shown generally at 58*a,* which is adapted to engage the outer peripheral surface of roll 52*a* so as to rotate roll 52*a* about spindle 48*a*. Similarly, web supply station 28*b* includes a web unwind mechanism 58*b* which is adapted to engage the outer peripheral surface of roll 52*b* to rotate roll 52*b.* Web supply station 32*a* includes an unwind mechanism 60*a* which is adapted to engage the outer peripheral surface of roll 54*a* to rotate roll 54*a,* and web supply station 32*b* includes an unwind mechanism 60*b* which is adapted to engage the outer peripheral surface of roll 54*b* to rotate roll 54*b.* In addition, each side of web supply section 22 includes a splicing mechanism for splicing together the trailing end of one of the rolls of web material with the leading end of the other of the rolls of web material. In this manner, the splicing together of the roll ends is operable to enable a continuous supply of the webs from both sides of web supply section 22 to wrapping section 20. A splicing mechanism 62 is located between web supply stations 28*a* and 28*b,* and a splicing mechanism 64 is located between web supply stations 32*a* and 32*b.*

Web unwind mechanisms 58*a,* 58*b* and 60*a,* 60*b* are identical in construction, and like reference characters will be used for each web unwind mechanism to facilitate clarity.

Figure 2B:
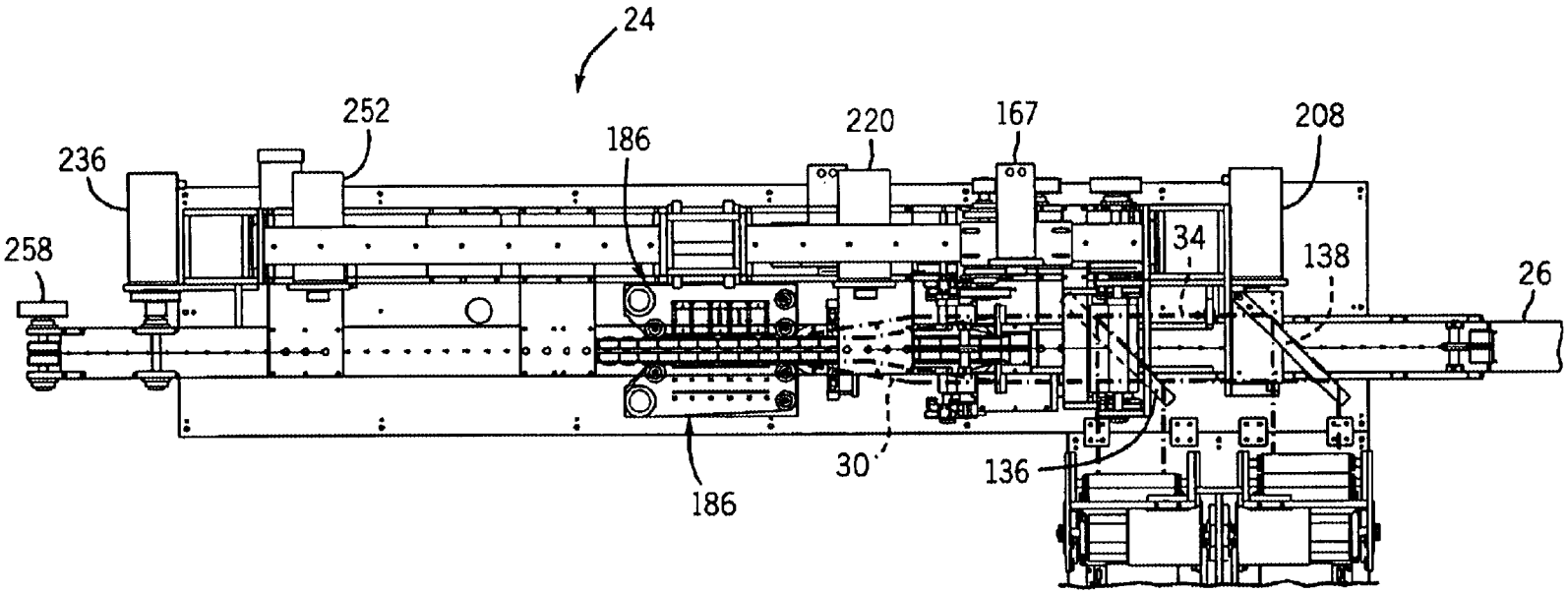
FIG. 2B is a top plan view of a portion of the wrapping system of FIG. 1, illustrating the article advancement and web application components of the system.

As shown in FIGS. 1–3, each web unwind mechanism 58*a,* 58*b,* 60*a* and 60*b* includes a frame 68 that is pivotably mounted at its lower end to and between a pair of plates 70. A box-type support 72 is secured to base plate 38, and includes an upper mounting plate 74 to which plates 70 are secured. A lever arm 76 is connected to each conveyor frame 68, and extends below upper mounting plate 74. An actuating cylinder assembly 78 is secured to support 72 below upper mounting plate 74, and includes an extendible and retractable actuating rod 80 pivotably secured at its outer end to lever arm 76. In this manner, operation of cylinder assembly 80 functions to provide pivoting movement of unwind mechanism frame 68, toward and away from its respective supply roll, about a pivot axis defined by the pivotable mounting of frame 68 to and between plates 70.

Each web unwind mechanism further includes an inner drive spindle 82 that extends along an axis coincident with the pivot axis of frame 68, and an outer idler spindle 84, both of which are rotatably mounted to frame 68. A drive belt 86 is trained about drive spindle 82 and idler spindle 84. Rotary power is input to each drive spindle 82 from a power input assembly 88, which includes a motor 90 that provides input power to a gear reducer 92, which in turn provides rotary input power to drive spindle 82 so as to impart rotation to drive spindle 82. In this manner, actuating cylinder 78 is operated to pivot frame 68 to a position in which drive belt 86 contacts the outer peripheral surface of the web supply roll, such as 52*a*, 52*b* and 54*a*, 54*b*. Operation of motor 90 causes drive belt 86 to move such that contact of drive belt 86 with the outer surface of the web supply roll functions to rotate the web supply roll about its associated spindle, such as 48*a,* 48*b* and 50*a,* 50*b.*

During normal operation, first web 30 is supplied from one of the web supply rolls 52*a,* 52*b,* and second web 34 is supplied from one of the web supply rolls 54*a,* 54*b.* First web 30 is routed through splicing mechanism 62, and through a festoon-type web storage or take-up mechanism 96 located downstream of splicing mechanism 62. Similarly, secured web 34 is routed through splicing mechanism 64 and is engaged with a festoon-type take-up or storage mechanism 98 located downstream of splicing mechanism 64. Normally, storage mechanisms 96, 98 are in the position of FIG. 3, in which the associated web 30, 34 travels through the storage mechanism in a serpentine path having long stretches or runs, such that a large quantity of web material travels in and through the storage mechanism. The serpentine path is defined by a series of stationary lower rollers 100 engaged with base plate 38, as well as a series of movable upper rollers 102 engaged with a movable frame assembly which includes a pair of spaced apart arms 104. At its end opposite rollers 102, each arm 104 is pivotably mounted to a support 106 extending upwardly from base plate 38, via a pivot connection 108.

Each storage mechanism 96, 98 further includes an extendible and retractable cylinder assembly 110 interconnected between base plate 38 and a cross member 111 which extends between frame arms 104. Cylinder assembly 110 includes an extendible rod, such that cylinder assembly 110 is operable to raise frame arms 104 and upper rollers 102, as shown in FIG. 3, and is also operable to enable frame arms 104 to be lowered so as to move upper rollers 102 toward lower rollers 100. With this construction, the frame assembly including arms 104 can be moved by operation of a cylinder assembly 110 between a lowered position as shown in FIG. 1 and a raised position as shown in FIG. 3 when the upper rollers 102 are in the raised position of FIG. 3, a significant quantity of the web, such as 30, 34, is located in the serpentine path defined by lower rollers 100 and upper rollers 102. When the upper rollers 102 are in the lowered position of FIG. 1, the overall length of the web in the storage mechanism 96, 98 is significantly less than when upper rollers 102 are in the raised position.

Normally, upper rollers 102 are raised, as shown in FIG. 3, to provide a maximum amount of first web 30 and second web 34 located within the serpentine path defined by storage mechanisms 96, 98, respectively.

Splicing mechanism 62 is located between web supply stations 28*a*, 28*b* and storage mechanism 96. Similarly, splicing mechanism 64 is located between web supply stations 32*a*, 32*b* and storage mechanism 98. Each splicing mechanism 62, 64 is operable to splice together the trailing end of an exhausted supply roll with the leading end of a fresh supply roll, to ensure a continuous supply of webs 30, 34 to wrapping section 24. Each splicing mechanism 62, 64 is operable to maintain stationary both the downstream and the upstream webs while the splicing operation is accomplished.

Figure 5:
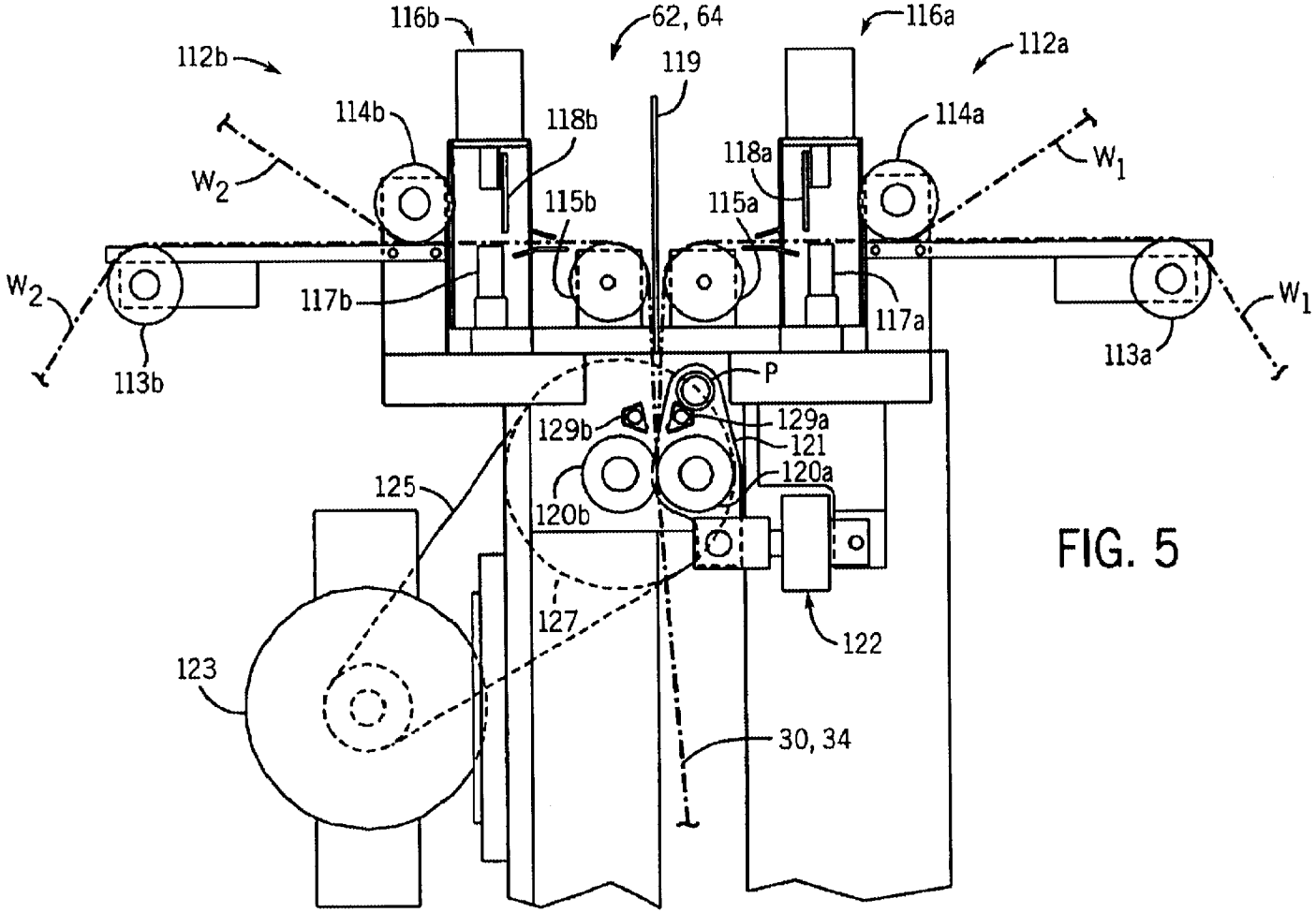
FIG. 5 is an enlarged partial side elevation view with reference to line 5—5 of FIG. 3, showing one of the splicing mechanisms for splicing together the trailing end of one web of wrapping material and the leading end of another web of wrapping material.

Splicing mechanisms 62 and 64 are identical in construction, and like reference characters will be used for each splicing mechanism to facilitate clarity. Referring to FIG. 5, each splicing mechanism 62, 64 includes a pair of mirror image web feed sections 112*a*, 112*b*, which include respective lower guide rollers 113*a*, 113*b*, and upper guide rollers 114*a*, 114*b*. Lower guide roller 113*a* engages the web of wrapping material, shown at $W_1$, which is supplied from a supply roll such as 52*a*, 54*a* when the supply roll is mounted such that web $W_1$ emanates from the bottom of the supply roll. Lower guide roller 113*b* similarly engages a web of wrapping material $W_2$ supplied from a supply roll such as 52*b*, 54*b* when the supply roll is mounted such that web $W_2$ emanates from the bottom of the supply roll. Upper guide rollers 114*a*, 114*b* engage and guide webs $W_1$, $W_2$, respectively, when the associated web supply roll is mounted such that the web emanates from the top of the supply roll. From guide rollers 113*a*, 113*b* and 114*a*, 114*b*, respective webs $W_1$ and $W_2$ are supplied to respective inner guide rollers 115*a*, 115*b*. A knife assembly 116*a* is located between upper guide roller 114*a* and inner guide roller 115*a*, and a knife assembly 116*b* is located between upper guide roller 114*b* and inner guide roller 115*b*. Webs $W_1$, $W_2$ pass over respective anvils 117*a*, 117*b* forming a part of respective knife assemblies, and knife assemblies 116*a*, 116*b* include respective guillotine-type knives 118*a*, 118*b*, each of which is mounted to the extendible and retractable rod of a selectively actuable cylinder assembly associated with the respective knife assembly 116*a*, 116*b*.

From respective inner guide rollers 115*a*, 115*b*, webs $W_1$, $W_2$ extend downwardly and are separated by a separator plate 119 located between inner guide rollers 115*a*, 115*b*. A selectively operable nip assembly is located below inner guide rollers 115*a*, 115*b*, and includes a movable nip roller 120*a* and a stationary nip roller 120*b*. Movable nip roller 120*a* is mounted to a bracket assembly which includes a pair of end plates 121 which are pivotably engaged with a pivot rod P. A pancake-type cylinder assembly 122 is mounted below nip roller 120*a*, and includes an extendible and retractable rod pivotably engaged with the lower end of end plates 121 at a location below movable nip roller 120*a*. With this arrangement, operation of cylinder assembly 122 is operable to selectively pivot the bracket assembly including end plates 121, to selectively bring nip roller 120*a* into contact with stationary nip roller 120*b* and to selectively move movable nip roller 120*a* to a position spaced from stationary nip roller 120*b*. A drive motor 123 is drivingly engaged with stationary nip roller 120*b* via a drive belt or chain 125, which is trained about the output member of drive motor 123 and an input sprocket 127 to which stationary nip roller 120*b* is mounted. A pair of vacuum bars 129*a*, 129*b* are mounted above respective nip rollers 120*a*, 120*b*.

In operation, each splicing mechanism 62, 64 functions as follows to splice together a pair of webs $W_1$, $W_2$. In the case of splicing mechanism 62, webs $W_1$, $W_2$ are supplied from respective supply rolls 52*a*, 52*b*, and in the case of splicing mechanism 64 webs $W_1$, $W_2$ are supplied from respective supply rolls 54*a*, 54*b*. During normal operation, one of webs $W_1$, $W_2$ is being advanced for supply to wrapping section 24. Representatively, the following description will identify the advancing web as web $W_1$, although it is understood that the advancing web could be either of webs $W_1$, $W_2$. During advancement, cylinder assembly 122 is extended so that movable nip roller 120*a* is moved into engagement with stationary nip roller 120*b*, so that the nip defined between rollers 120*a*, 120*b* functions to advance the web and to draw the web off of the respective supply roll. During such advancement of web $W_1$, an operator loads a supply roll such as 52*b*, 54*b* onto its respective web supply station 28*b*, 32*b*, and manually advances web $W_2$ off of its supply roll so as to position the web either over lower glide roller 113*b* or under upper guide roller 114*b*, and through knife assembly 116*b* above anvil 117*b* and below knife 118*b*. The operator applies a length of splice tape to the end of web $W_2$, to the surface of web $W_2$ that faces web $W_1$ when the operator advances web $W_2$ over inner guide roller 115*b*. Separator plate 119 functions to maintain webs $W_1$, $W_2$ apart from each other as webs $W_1$, $W_2$ extend downwardly from respective inner guide rollers 115*a*, 115*b*. The operator continues to advance web $W_2$ downwardly so that the end of web $W_2$ is located just above the nip defined between nip rollers 120*a*, 120*b*, and vacuum is supplied to vacuum bar 129*b* so as to draw the end of web $W_2$ away from web $W_1$ and to thereby prevent webs $W_1$, $W_2$ from coming together.

When it is desired to initiate the splicing operation, i.e. when the supply roll for web $W_1$ is nearly exhausted, knife assembly 116*a* is operated so as to sever web $W_1$. The vacuum to tube 129*b* is cut off so as to release the end of web $W_2$ to which the splice tape is applied. Pancake cylinder assembly 122 is then moved from its retracted position to its extended position, to catch the leading end of web $W_2$ in the nip between stationary nip roller 120*b* and movable nip roller 120*a,* which functions to clamp the trailing end of web $W_1$ and the leading end of web $W_2$ between nip rollers 120*a,* 120*b*. This clamping action on the splicing areas of webs $W_1$, $W_2$ functions to temporarily stop the advancement of web $W_1$, and drive motor 123 is operated so as to slowly advance the splicing areas of webs $W_1$, $W_2$ so as to apply pressure to the overlapping web areas with the splice tape located therebetween. The spliced areas of webs $W_1$, $W_2$ are advanced slowly, to enable the adhesive between webs $W_1$, $W_2$ to cure to a degree sufficient to ensure that webs $W_1$, $W_2$ remain intact and spliced together for subsequent advancement through web supply section 22. During this time, the festoon-type web storage mechanism, such as 96, 98, functions in the manner described above to enable the stored length of web $W_1$ to continually be advanced through web supply section 22. Once the splicing operation is complete, the festoon-type web storage mechanism such as 96, 98 again returns to its extended position so as to store the required length of web material in preparation for a subsequent splicing operation.

Once the splicing operation is complete, the web $W_2$ is the web, such as first web 30 or second web 34, which is supplied through web supply section 22 to wrapping section 24. While web $W_2$ is being unwound from its associated supply roll, the operator removes the core and the tail end portion of the supply roll of the prior web $W_1$, and mounts a fresh supply roll of web $W_1$ to be spliced together with the tail end of web $W_2$ when the supply of web $W_2$ is exhausted. To do so, the operator applies splice tape to the leading end of the fresh supply of web $W_1$, and threads web $W_1$ about the desired one of lower guide roller 113*b* or upper guide roller 114*b,* through knife assembly 116*b* and over inner guide roller 115*b*. Vacuum is supplied to vacuum tube 129*b,* to retain the end of web $W_1$ away from the path of movement of web $W_2$. When it is desired to splice the leading end of web $W_1$ to the trailing end of web $W_2$, the splicing operation takes place as described above. In this manner, the supply of web material is continuous, to accommodate the continuous length of the elongated article 26 being supplied to wrapping section 24 of wrapping system 20.

Each side of web supply section 22 further includes a nip-type unwind drive assembly, each of which applies tension to its respective web so as to advance the web through web supply section 22. An unwind drive assembly 124 (FIG. 1) is engaged with first web 30 at the discharge of web supply section 22. Similarly, an unwind drive assembly 126 (FIG. 3) is engaged with second web 34 at the discharge of web supply section 22. Each unwind drive assembly 124, 126 is of conventional construction, and includes a motor which drives a nip roll arrangement so as to apply tension to the upstream area of the web to pull the web through the web supply section 22. As shown in FIG. 3, each of webs 30, 34 extends through a space defined below its associated support 72 from the endmost stationary lower roller such as 100 of its associated web storage mechanism 96, 98, and engages an idler roller such as 128, to redirect the web upwardly toward its associated unwind drive assembly 124, 126.

Downstream of unwind drive assemblies 124, 126, respective webs 30, 34 are engaged with a counterweighted dancer-type tension balancing mechanism 130, which is operable to ensure that webs 30, 34 are subjected to an equal amount of tension upon supply to wrapping section 24 of wrapping system 20.

Web supply section 22 of wrapping system 20 is oriented relative to wrapping section 24 such that webs 30, 34 travel in a direction generally perpendicular to the direction in which elongated article 26 is advanced by wrapping section 24. At the discharge end of web supply section 22, first web 30 engages a lower 132 located downstream of tension balancing mechanism 130, and second web 34 travels upwardly for engagement with an upper roller 134. Wrapping section 24 includes a lower diagonally oriented turn bar 136 with which lower web 30 is engaged, and a diagonally oriented upper turn bar 138 with which upper web 34 is engaged. Turn bars 136, 138 are oriented so as to convert the direction of motion of webs 30, 34, respectively, from a direction transverse to the longitudinal axis of wrapping section 24 to a direction in line with the longitudinal axis of wrapping section 24.

Figure 6:
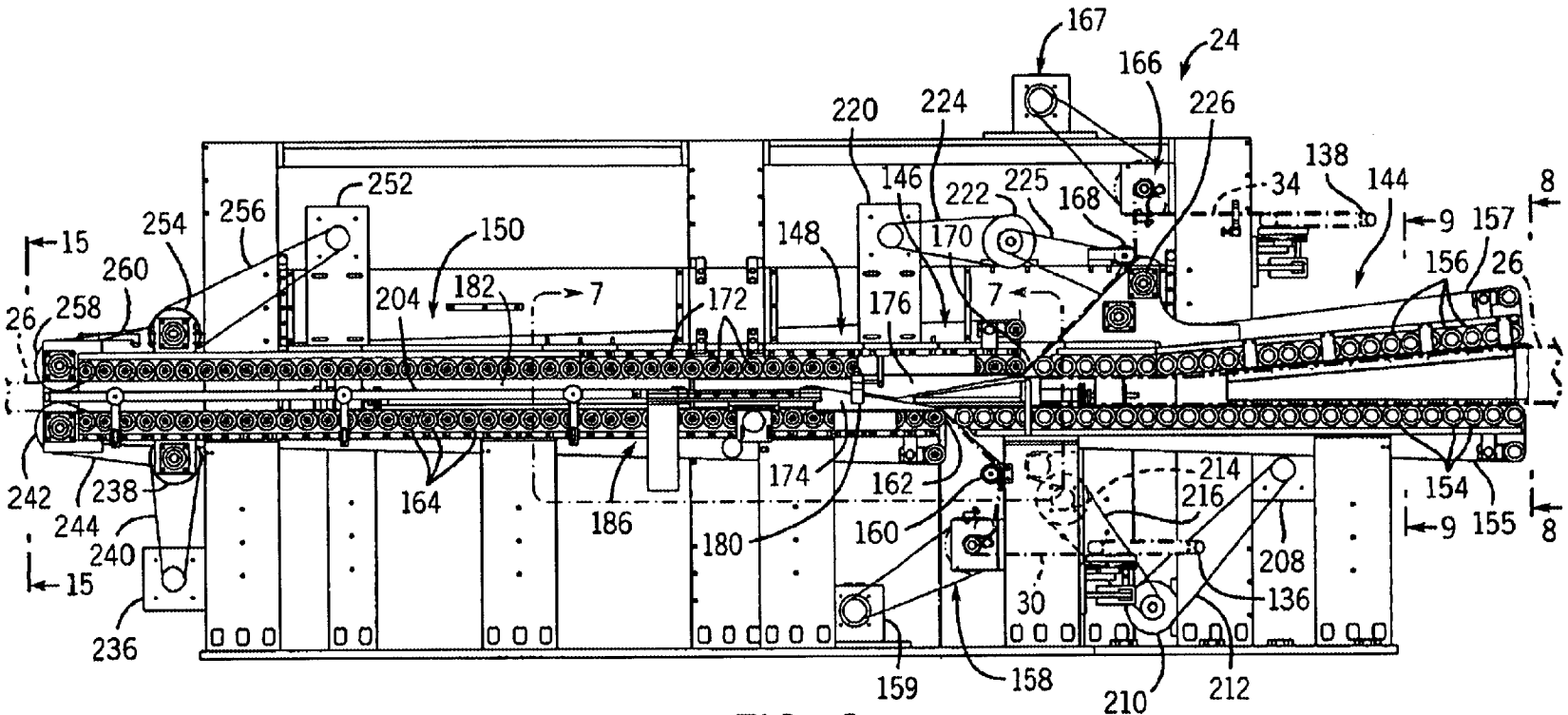
FIG. 6 is a section view taken along line 6—6 of FIG. 3.

Wrapping section 24 functions in a manner generally similar to prior art wrapping devices, such as is available from Development Industries, Inc. of Green Bay, Wis. under its Model No. 120. As shown in FIG. 6, wrapping section 24 generally includes an inlet compression section 144, a web application area 146, an adhesive application area 148, and a discharge section 150.

Inlet compression section 144 includes a lower set of rollers 154 that support the upper run of a lower drive belt 155, and an upper set of rollers 156 that overlie the lower run of an upper drive belt 157. Upper rollers 156 converge toward lower rollers 154 in an upstream-to-downstream direction, so that the facing surfaces of lower drive belt 155 and upper drive belt 157 apply a compressive force to elongated article 26 as elongated article 26 travels through inlet compression section 144. At the downstream end, upper rollers 156 are spaced equally from lower rollers 154, so as not to apply additional compression to elongated article 26 immediately upstream of web application area 146. In this manner, the elongated article 26, which may representatively be a stack of interfolded paper towels or the like, is compressed prior to wrapping with webs 30, 34.

Lower web 30 is supplied from turn bar 136 to a set of pull rolls 158 driven by a motor 159, which function to apply tension to web 30 to advance web 30. Downstream of pull rolls 158, web 30 is engaged with a load cell 160, and passes through an opening 162 between the downstream roller 154 of inlet compression section 144 and the upstream one of the upper discharge section rollers, shown at 164, to a location in which web 30 comes into contact with the lower surface of article 26. Similarly, upper web 34 is engaged with a set of pull rolls 166 driven by a motor 167, located downstream of upper turn bar 138. Downstream of upper pull rolls 166, upper web 34 is engaged with a load cell 168, and is supplied through an opening 170 between the downstream one of upper rollers 156 and the upstream one of the upper discharge section rollers, shown at 172. In this manner, upper web 34 is applied to the upper surface of elongated article 26.

A lower web former 174 is located downstream of lower opening 162, and includes a pair of angled forming wings adapted to engage the sides of lower web 30 located outwardly of elongated article 26, for folding the sides of lower web 30 upwardly about the sides of elongated article 26. Similarly, an upper web former 176 is located downstream of upper opening 170, and includes a pair of wings adapted to engage the sides of upper web 34 located outwardly of elongated article 26, for folding the sides of upper web 34 downwardly about the sides of elongated article 26. Upper web former 176 is located upstream of lower web former 174, such that the outer areas of upper web 34 are folded downwardly against the sides of elongated article 26 prior to upward folding of the outer portions of lower web 30 by web former 174. Lower and upper webs 30, 34, respectively, each have a width which is sufficient to provide an overlapping area of the adjacent side edges of lower web 30 and upper web 34 subsequent to folding of lower and upper webs 30, 34 by web formers 174, 176, respectively.

Adhesive application area 148 includes a pair of glue applicators 180 located one on either side of elongated article 26, each of which is positioned to apply a line of adhesive such as glue between the overlapping portions of lower and upper webs 30, 34, respectively.

Downstream of lower and upper web formers 174, 176, respectively, and glue applicators 180, discharge section 150 includes respective lower and upper rollers 164, 172 which are positioned to provide a constant height passage 182 through which elongated article 26 travels subsequent to application of lower and upper webs 30, 34, respectively. A lower drive belt 165 is engaged with lower rollers 164, and an upper drive belt 173 is engaged with lower rollers 172. The facing runs of respective lower and upper drive belts 165, 173 engage elongated article 26 to advance elongated article 26 through passage 182. Passage 182 has a length sufficient to maintain compression on the wrapped elongated article 26 for a duration that enables the glue applied between the overlapping portions of respective lower and upper webs 30, 34 to set, when elongated article 26 is advanced through passage 182 at its top speed of operation by drive belts 165, 173.

Figure 7:
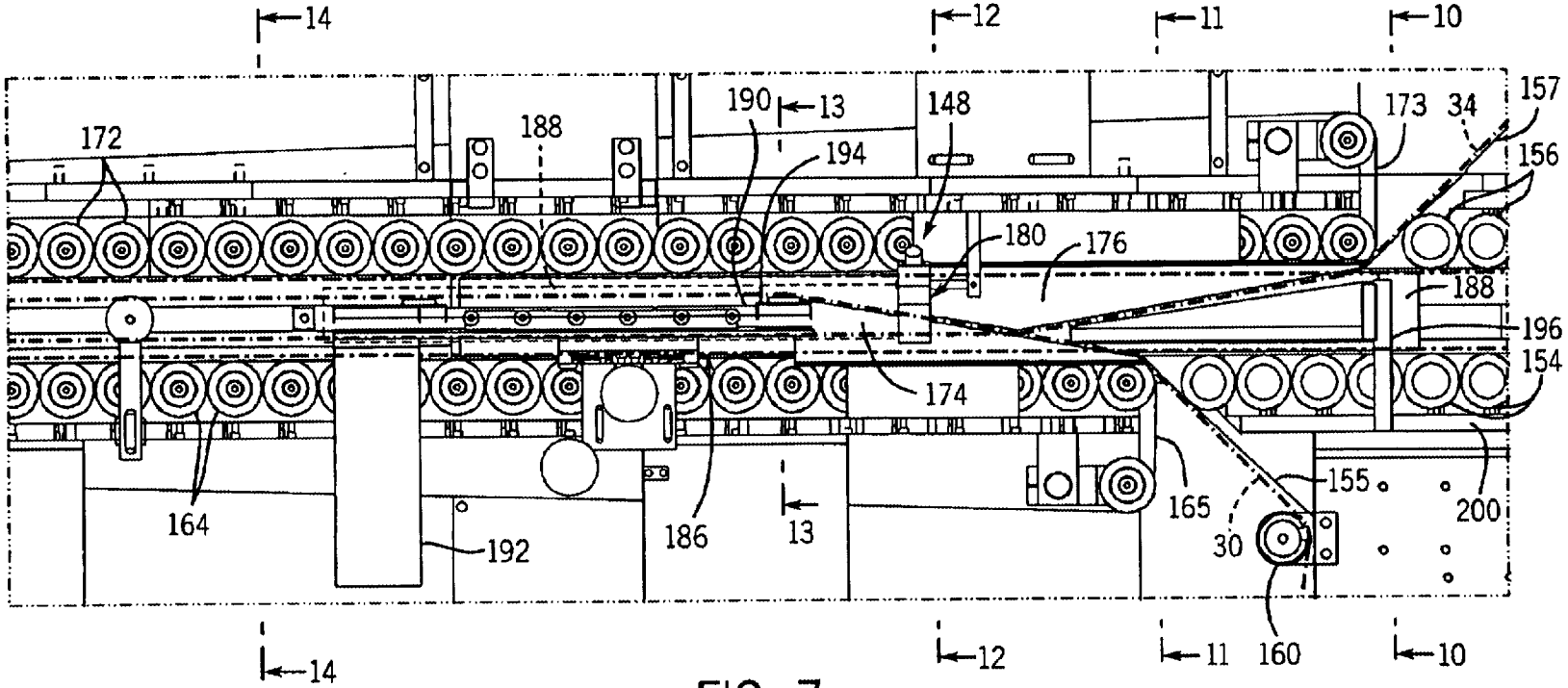
FIG. 7 is an enlarged partial elevation view showing a portion of the wrapping system illustrated at line 7—7 of FIG. 6.
Figure 8:
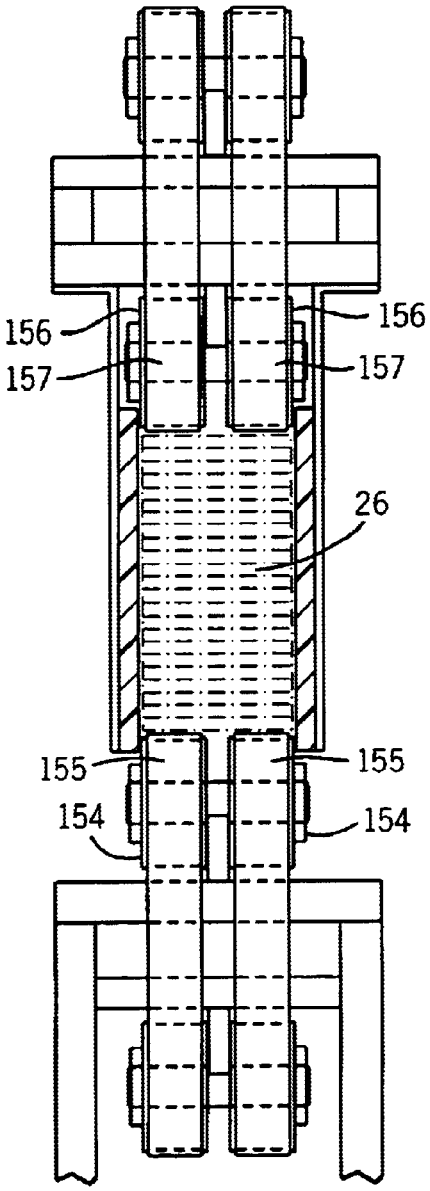
FIG. 8 is a partial section view taken along line 8—8 of FIG. 6.
Figure 9:
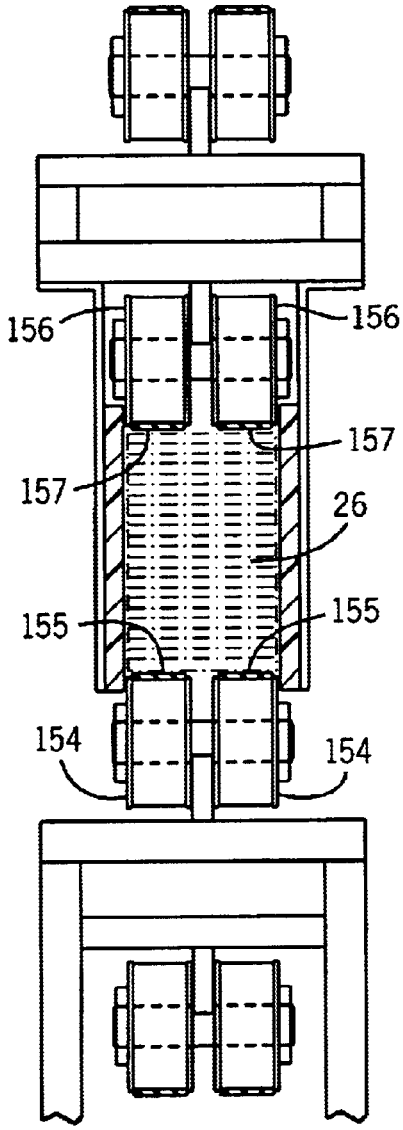
FIG. 9 is a partial section view taken along line 9—9 of FIG. 6.
Figure 10:
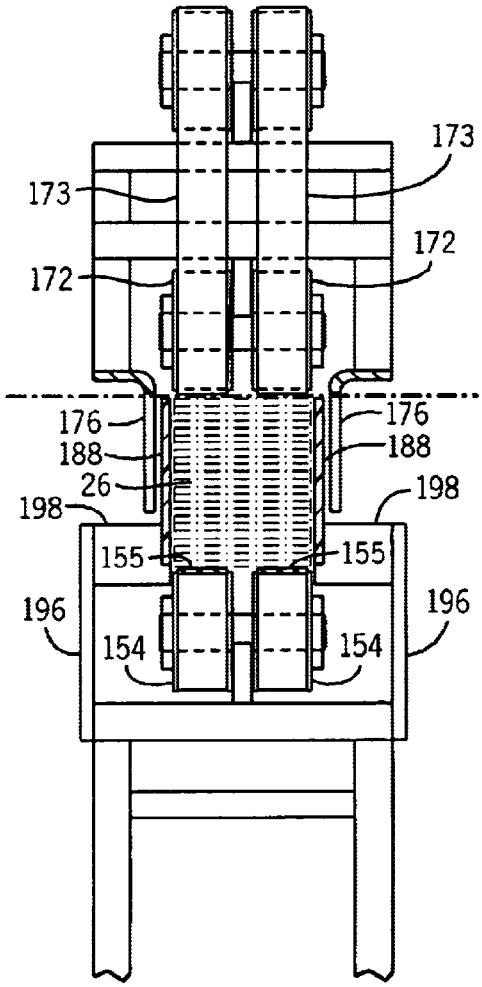
FIG. 10 is a partial section view taken along line 10—10 of FIG. 7.
Figure 11:
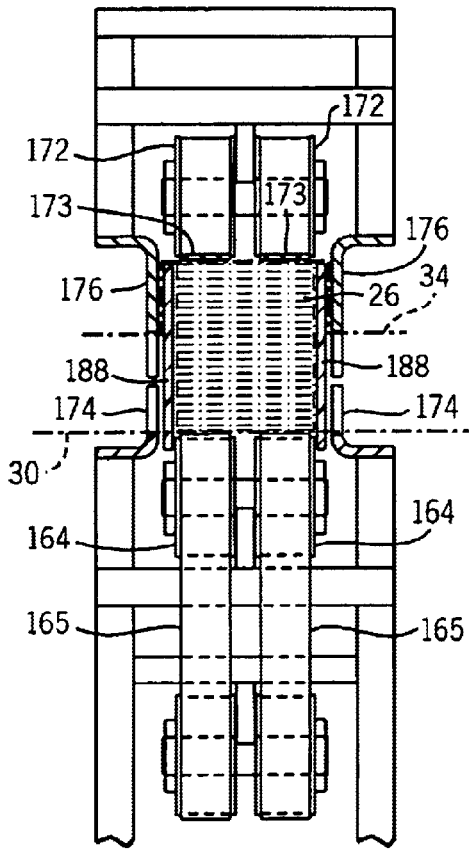
FIG. 11 is a partial section view taken along line 11—11 of FIG. 7.
Figure 13:
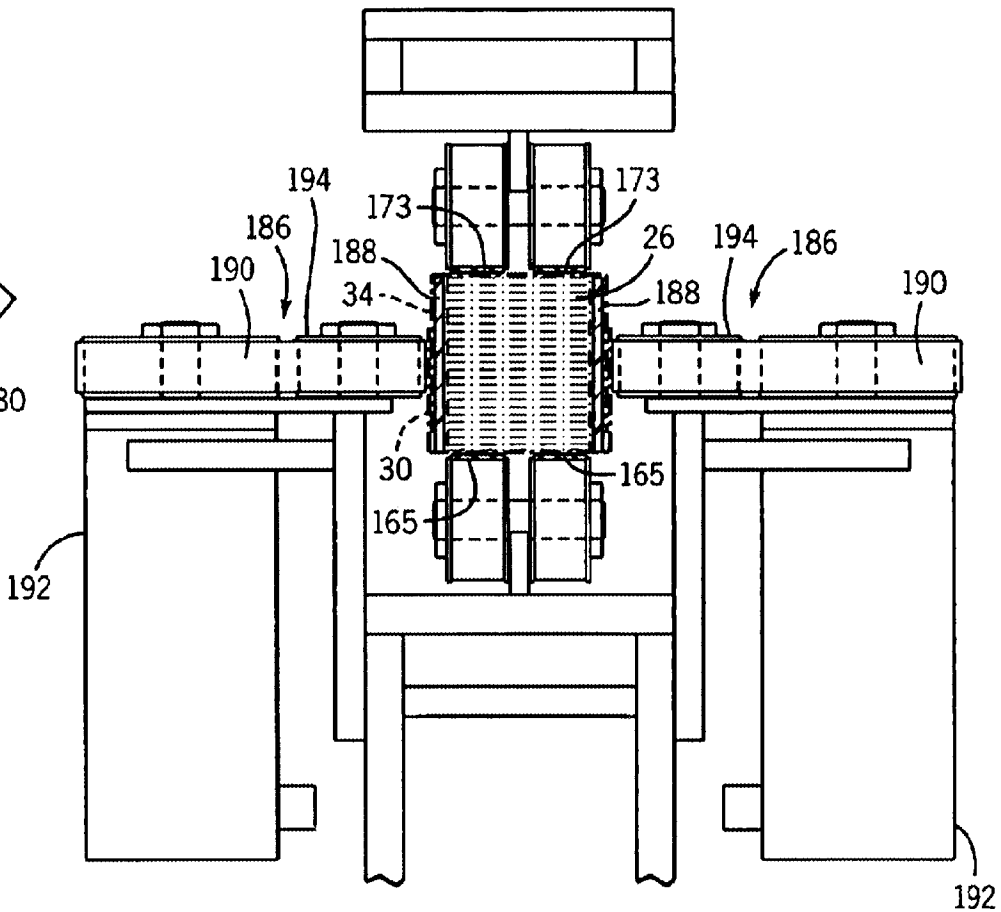
FIG. 13 is a partial section view taken along line 13—13 of FIG. 7.
Figure 12:
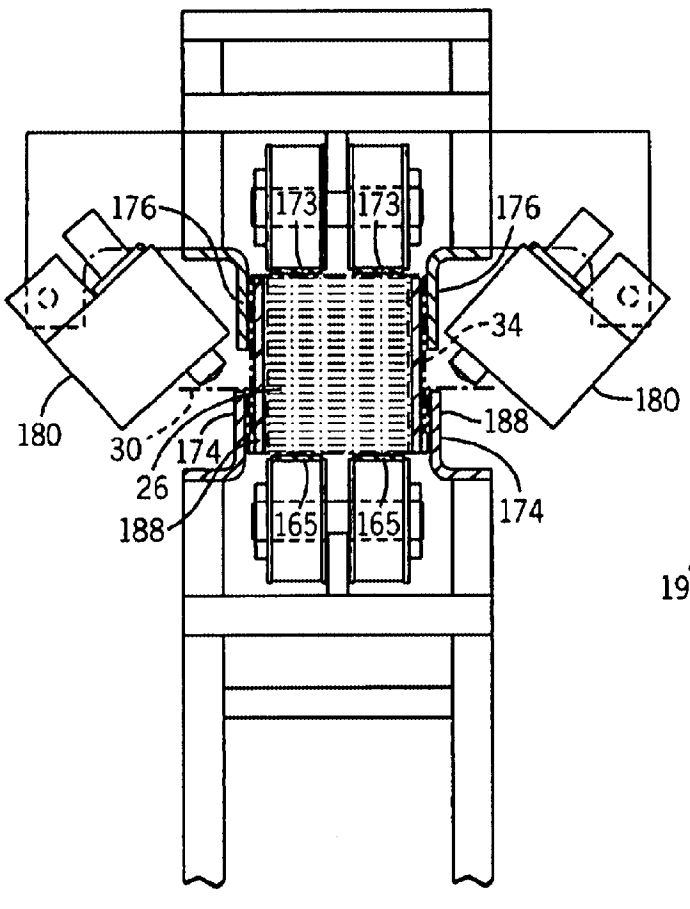
FIG. 12 is a partial section view taken along line 12—12 of FIG. 7.
Figure 14:
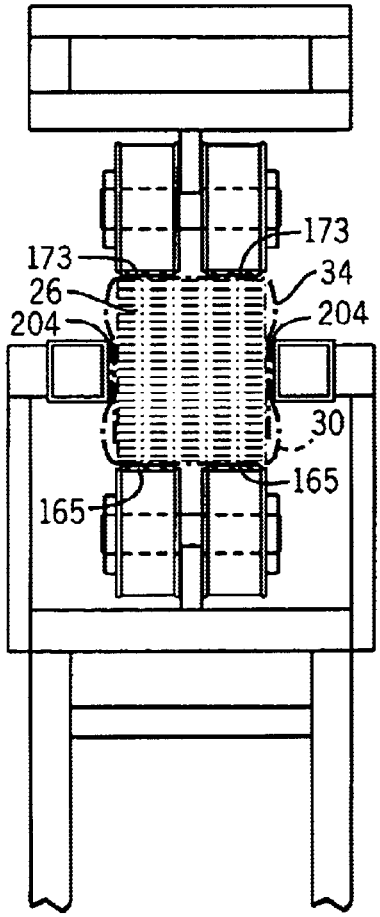
FIG. 14 is a partial section view taken along line 14—14 of FIG. 7.
Figure 15:
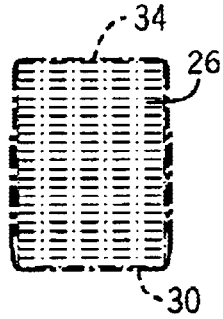
FIG. 15 is a section view of an elongated stack of interfolded paper towels wrapped utilizing the wrapping system of the present invention as shown in FIGS. 1–14.

On each side of passage 182, a pressure application assembly 186 is located at the upstream end of discharge section 150, immediately downstream of glue applicator 180. Each pressure application assembly 186 includes a cantilevered backing plate 188 which is located between the side of elongated article 26 and the overlapping area of webs 30, 34. Pressure application assembly 186 further includes a side seal belt 190 engaged with the output of a drive motor 192 and trained about an idler roller 194 (FIG. 7). Each backing plate 188 extends rearwardly from upper web former 176, and is supported by support structure interconnected with the frame of wrapping section 24, including an upright support member 196, FIGS. 7, 10, and an inwardly extending support member 198 that extends inwardly from the upper end of upright support member 196 and is connected to backing plate 188. At its lower end, upright support member 196 is secured to a frame member 200 forming a part of the frame structure of wrapping section 24. In this manner, each backing plate 188 is supported in a cantilever fashion at its upstream end, and extends in a downstream direction throughout the length of lower and upper web formers 174, 176, respectively, and the length of pressure application assembly 186. Lower and upper webs 30, 34, respectively, are formed against backing plates 188, which provide a hard surface for seal belt 190 to bear against. The inner facing runs of side seal belts 190 are urged inwardly toward backing plate 188 via a series of shoes. With this construction, seal belts 190 and backing plates 188 function to apply high pressure to the overlapping areas of webs 30, 34 and the adhesive placed therebetween, to "iron out" the adhesive and distribute the adhesive evenly between the overlapping areas of webs 30, 34.

Downstream of pressure application assembly 186, discharge section 150 of wrapping section 24 includes a pair of cooling bars 204 located one on either side of passage 182, that extend throughout the remainder of the length of discharge section 150. Each cooling bar 204 is located so as to overlie the overlapping areas of webs 30, 34, and engages the outer surface of lower web 30 as the wrapped elongated article 26 is advanced through discharge section 150. Cooling bars 204 function to dissipate heat from the hot glue applied by glue applicators 180, to enable the glue to cure prior to discharge of the wrapped elongated article 26 from discharge section 150. Cooling bars 204 may be cooled via a refrigeration unit, if necessary, to ensure that the glue is sufficiently cured prior to discharge from discharge section 150 so as to retain lower and upper webs 30, 34, respectively, about elongated article 26.

As shown in FIG. 6, inlet compression section 144 of wrapping section 24 includes a lower drive motor 208 that provides input power to a pulley 210 via a belt 212. In turn, pulley 210 is engaged with a pulley connected to an input roller 214 via a belt 216, and lower drive belt 155 is engaged with input roller 214 to impart movement to lower drive belt 155. Belt 155 is supported by lower driven rollers 154, which act as idler rollers, such that the upwardly facing surface of the upper run of lower drive belt 155 functions to engage the lower surface of elongated article 26 as elongated article 26 is supplied to inlet compression section 144. Similarly, an upper drive motor 220 is engaged with a pulley 222 via a belt 224, and a belt 225 extends between pulley 224 and a pulley connected to an input roller 226. Upper drive belt 157 is engaged with input roller 226 to impart movement to upper drive belt 157. Upper drive belt 157 is engaged with upper driven rollers 156, which thus function as idler rollers. The downwardly facing surface of the lower run of upper belt 157 functions to engage the upper surface of elongated article 26, to cooperate with lower belt 155 to provide advancement of elongated article 26 through inlet compression section 144.

In a similar manner, discharge section 150 includes a lower drive motor 236 engaged with a pulley 238 via a belt 240, which in turn is engaged with an input pulley 242 via a belt 244. Input pulley 242 is connected to an input roller with which lower drive belt 165 is engaged. Lower rollers 164 act as idler rollers by engagement with belt 165. In this manner; the upper run of lower belt 165 engages the lower surface of lower web 30 to advance the wrapped elongated article 26 through discharge section 150. An upper drive motor 252 is engaged with a pulley 254 via a belt 256, which provides input power to an input pulley 258 via a belt 260. An input roller 262 is driven by input pulley 258, and upper belt 173 is engaged with input roller 262 and with upper rollers 172. In this manner, upper rollers 172 act as idler rollers, and the lower run of belt 173 cooperates with the upper run of lower belt 165 to form the advancement mechanism by which the wrapped elongated article 26 is advanced through passage 182.

A power lift arrangement is interconnected with the upper components of wrapping section 24 so as to enable upper rollers 156 and 172 to be raised relative to lower rollers 154 and 164, respectively. This provides the ability to clear any jams which may occur during operation, and to accommodate initial threading of elongated article 26 into and through wrapping section 24.

In operation, elongated article 26 is continuously supplied to inlet compression section 144 of wrapping section 24, and is advanced through inlet compression section 144 by lower and upper drive belts 155, 157, respectively. Upon discharge from inlet compression section 144, elongated article 26 is moved to web application area 146 where lower web 30 and upper web 34 are applied to the lower and upper surfaces, respectively, of elongated article 26. Lower and upper web formers 174, 176 function to fold the sides of lower and upper webs 30, 34, respectively, into an overlapping relationship, with backing plate 188 being located between the side surface of elongated article 26 and the overlapping folded sides of lower and upper webs 30, 34 on each side of elongated article 26. Glue applicator 180 applies a line of heated adhesive between the overlapping areas of respective lower and upper webs 30, 34, which are then pressed together against backing plate 188 by belt 190 of pressure application assembly 186, to form a sleeve-type package or wrapper about elongated article 126. Lower and upper belts 165, 173, respectively, of discharge section 150 then function to continue advancement of the wrapped elongated article 26 through passage 182 defined by discharge section 150, and cooling bars 204 engage the outer surfaces of lower web 30 at the area of overlap between lower web 30 and upper web 34, to extract heat from the glue seal between webs 30, 34. By the time the wrapped elongated article 26 reaches the outlet of discharge section 150, the glue applied between the overlapping areas of webs 30, 34 together to form a sleeve-type wrapper about elongated article 26. The wrapped elongated article 26 is then discharged from discharge section 150 to a log saw, which functions to sever the wrapped elongated article 26 into individual packages.

As described previously, web supply section 22 functions to continuously supply lower and upper webs 30, 34, respectively, to wrapping section 24 during advancement of elongated article 26. The various components and operations of web supply section 22 and wrapping section 24 are controlled via a central controller using appropriate hardware and software, to ensure that the speeds of operation and other operating parameters of both web supply section 22 and wrapping section 24 are coordinated during operation.

While the invention has been shown and described with respect to a particular embodiment, it is understood that variations and alternatives are contemplated as being within the scope of the present invention. For example, and without limitation, while webs 30, 34 are shown and described as being formed of a pulp-based material and glued together, it is understood that webs 30, 34 may also be formed of a thermoplastic material which can be secured together via a heat seal or the like. Further, while elongated article 26 is described as a compressible stack of interfolded paper towels, it is understood that wrapping system 20 may be employed to wrap any type of elongated article using a pair of webs of wrapping material. In addition, while elongated article 26 is shown as being subjected to compression prior to wrapping, it is understood that it is not necessary to compress the article prior to application of the webs. Further, while web supply section 22 is shown as being oriented transverse to wrapping section 24 to supply webs 30, 34 in a transverse direction from an offset location, it is also understood that web supply section 22 may be oriented so as to be in line with wrapping section 24. While the web supply stations are shown and described as having web unwind mechanisms that engage the surface of the roll to unwind the web from the roll, it is also understood that the web may be unwound from the roll using a center drive web unwind mechanism, in which the roll is rotated by driving the center spindle on which the roll is supported. In addition, while the splicing mechanisms incorporated in the wrapping system of the present invention are shown and described as being of the type that temporarily maintain the web stationary during the splicing operation, it is also understood that a flying splice arrangement may be employed. In this type of splicing arrangement, the trailing end of the exhausted web is cut and bonded together with the leading end of the fresh web on the fly, without maintaining the webs stationary.

Various alternatives and embodiments are contemplated as being within the scope of the following claims particularly pointing out and distinctly claiming the subject matter regarded as the invention.

I claim:

1. An apparatus for wrapping an elongated article, comprising:

an advancing mechanism engaged with the elongated article, wherein the advancing mechanism is operable to advance the elongated article in a direction along a longitudinal axis defined by the elongated article;

a web supply arrangement for supplying one or more webs of wrapping material;

a web application arrangement for applying the one or more webs of wrapping material to the elongated article so as to form an overlapping area of the wrapping material at an overlap location; and a bonding arrangement for bonding the overlapping area of the one or more webs together to secure the one or more webs about the elongated article, wherein the bonding arrangement includes application means upstream of the overlap location for applying a bond-forming agent to the overlapping area of the wrapping material; an internal backing member located adjacent the elongated article and underlying the overlapping area of the one or more webs, wherein the internal backing member extends downstream from the overlap location and downstream from the application means; and a pressure application arrangement located downstream of the application means, wherein the pressure application arrangement includes a pressure-applying member that bears against the overlapping area of the wrapping material and against the internal backing member to apply pressure to the overlapping area of the wrapping material and to the bond-forming agent to secure the overlapping area of the one or more webs together.

2. The apparatus of claim 1, wherein the application means comprises an adhesive application arrangement and wherein the bond-forming agent comprises an adhesive applied by the adhesive application arrangement between the overlapping area of the one or more webs as the one or more webs are applied to the elongated article.

3. The apparatus of claim 2, wherein the web supply arrangement is configured and arranged to apply first and second webs of wrapping material about the elongated article to form a pair of overlapping areas, and wherein the bonding arrangement is configured to bond both the overlapping areas together.

4. The apparatus of claim 2, wherein the web supply arrangement is configured and arranged to supply one or more continuous webs of wrapping material about the elongated article.

5. The apparatus of claim 4, wherein the web supply arrangement is configured and arranged to apply first and second continuous webs of wrapping material about the elongated article to form a pair of overlapping areas, and wherein the bonding arrangement is configured to bond both the overlapping areas together.

6. The apparatus of claim 2, wherein the internal backing member comprises a cantilevered internal backing plate mounted upstream of the web application arrangement and extending in downstream direction toward the web application arrangement so as to underlie the overlapping area of the one or more webs as the one or more webs are formed about the elongated article.

7. The apparatus of claim 2, wherein the adhesive application arrangement applies the adhesive in a heated state, and further comprising a cooling arrangement located downstream of the pressure application arrangement, wherein the cooling arrangement is configured and arranged to cool the adhesive and the overlapping area of the one or more webs adjacent the adhesive.

8. A method of wrapping an elongated article, comprising the acts of:

advancing the elongated article in a downstream direction along a longitudinal axis defined by the elongated article;

supplying at least one web of wrapping material to a web application arrangement;

applying the at least one web of wrapping material about the elongated article via the web application arrangement so as to form at least one overlapping area of wrapping material at an overlap location; and securing the overlapping area of the at least one web together by applying an adhesive to the areas of wrapping material defining the overlapping area of wrapping material, and applying pressure on the overlapping area of wrapping material, subsequent to application of the adhesive, at a location downstream of the overlap location against an internal backing member that extends downstream from the overlap location and that is located between the elongated article and the overlapping area of wrapping material.

9. The method of claim 8, wherein the act of applying at least one web of wrapping material comprises applying first and second webs of wrapping material to form a pair of overlapping areas, and including the acts of securing both of the overlapping areas together.

10. The method of claim 9, wherein the act of applying first and second webs of wrapping material is carried out by continuously applying the first and second webs of wrapping material.

11. The method of claim 8, wherein the act of securing the overlapping area of the at least one web together includes compressing the elongated article subsequent to application of pressure to the overlapping area of the at least one web of wrapping material for a duration sufficient to enable the adhesive to set.

12. The method of claim 8, wherein the act of applying pressure to the overlapping area of the at least one web is carried out via a rotatable member that faces the internal backing member and engages the overlapping area of the at least one web that is located between the internal backing member and the rotatable member.

13. The method of claim 8, wherein the act of applying the adhesive is carried by applying the adhesive in a heated state, and further comprising the act of cooling the adhesive and portions of the overlapping area of the wrapping material adjacent the adhesive at a location downstream of the location at which pressure is applied to the overlapping area of wrapping material.

* * * * *